US005102347A

United States Patent [19]

Cote et al.

[11] Patent Number: 5,102,347

[45] Date of Patent: Apr. 7, 1992

[54] INSULATION DISPLACEMENT TERMINAL FOR TELECOMMUNICATION DEVICES

[75] Inventors: Mark P. Cote, Springvale; Tom W. Kroll, South Portland; John J. Napiorkowski, Cape Elizabeth, all of Me.

[73] Assignee: GTE Products Corporation, Stamford, Conn.

[21] Appl. No.: 745,781

[22] Filed: Aug. 16, 1991

[51] Int. Cl.[5] ..... H01R 4/24

[52] U.S. Cl. ..... 439/412; 439/936; 439/416

[58] Field of Search ..... 439/409–419, 439/801, 792, 793, 797, 936

[56] References Cited

U.S. PATENT DOCUMENTS 4,846,721 7/1989 DeBruycker et al. ..... 439/411
4,911,615 3/1990 Pinyan et al. ..... 439/412
4,971,573 11/1990 Pinyan et al. ..... 439/412

FOREIGN PATENT DOCUMENTS 0471769 11/1914 France ..... 439/411
0460106 9/1968 Switzerland ..... 439/411

*Primary Examiner*—David L. Pirlot
*Attorney, Agent, or Firm*—James Theodosopoulos

[57] ABSTRACT

An insulation displacement terminal comprises a clamp having an internally threaded tubular portion to accommodate a screw. An insulated telephone wire can be inserted into an aperture in the clamp. When the screw is screwed all the way into the clamp, a cylindrical blunt edge thereon will displace the insulation on the wire and make contact with the metal core of the wire. There is a sealing material in the terminal to seal around the point of contact. A well and axial hole in the screw can accommodate sealing material that is displaced by the screw.

7 Claims, 2 Drawing Sheets

INSULATION DISPLACEMENT TERMINAL FOR TELECOMMUNICATION DEVICES

BACKGROUND

This invention concerns insulation displacement terminals for use with telecommunication devices. Such a terminal is disclosed in U.S. Pat. No. 4,971,537. It is especially concerned with such a terminal in which the point of physical contact between the terminal and the metal core of an insulated telephone wire is protected against the environment by a sealing material. Such a terminal is shown in U.S. Pat. No. 4,846,721, where the terminal is mounted in a terminal block. For displacement of sealing material, there is an aperture in the terminal block to receive displaced sealing material.

SUMMARY OF THE INVENTION

In this invention, means are provided in the terminal itself to receive displaced sealing material. This permits the unit to be more compact.

A terminal in accordance with one aspect of this invention consists of a clamp, a portion of which is tubular, the tubular portion being internally threaded to accommodate a screw. There is an aperture in the clamp to accommodate a telephone wire. The end of the screw has a small cylindrical blunt edge for piercing the insulation of the telephone wire and making contact with the metal core thereof when the telephone wire is squeezed between the cylindrical blunt edge and a flat surface of the clamp. There is a cylindrical cavity at the bottom of the clamp, the inside diameter of which is equal to and in alignment with, the inside diameter of the cylindrical blunt edge of the screw. The purpose of the cavity is to allow telephone wire insulation to be displaced thereinto. The flat surface of the clamp is peripheral the cavity. There is an axial hole throughout the length of the screw to permit sealing material to be displaced thereinto. The axial hole may also be used to inject sealing material into the clamp prior to insertion of the telephone wire. There is a head on the screw which, when the screw is completely screwed into the clamp, is stopped by a shoulder on the clamp, which prevents the blunt edge of the screw from cutting through the metal core of the telephone wire.

In another aspect of the invention, one or more ring-shaped spring washers is placed between the cylindrical blunt edge and the flat surface of the clamp. The reason for this is to reduce the tolerances required for manufacture of the terminal.

In another aspect of the invention, the cylindrical blunt edge is not located directly on the screw but is located on a floating cup partially disposed within the screw and having up-and-down movement within the screw. A coiled spring is disposed between the screw and the floating cup and exerts downward pressure on the floating cup.

PREFERRED EMBODIMENT

Figure 1:
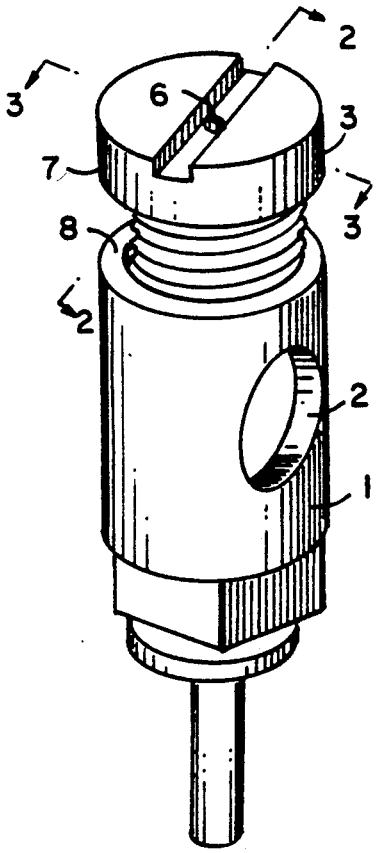
FIG. 1 is a perspective view of a terminal in accordance with this invention.
Figure 2:
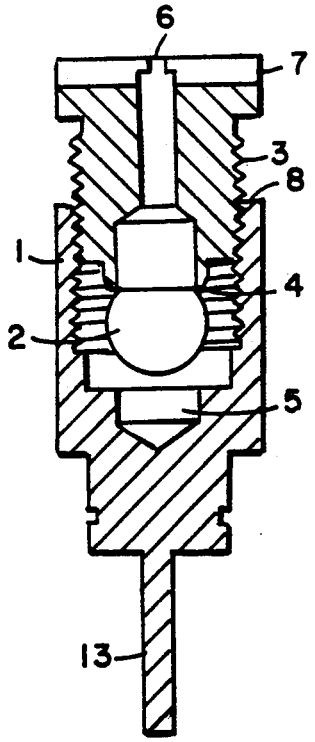
FIG. 2 is a sectional view along line 2—2 of FIG. 1.
Figure 3:
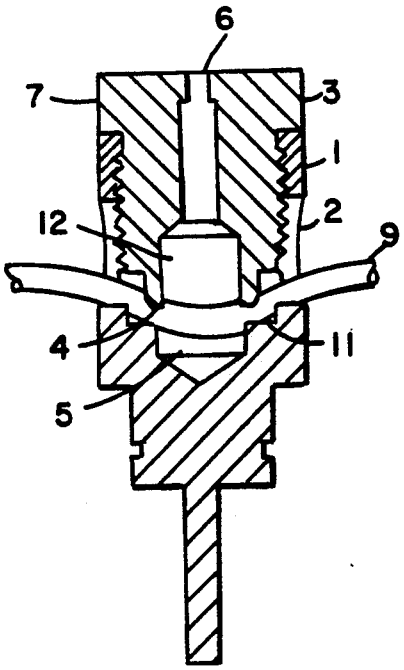
FIG. 3 is a sectional view along line 3—3 of FIG. 1.
Figure 4:
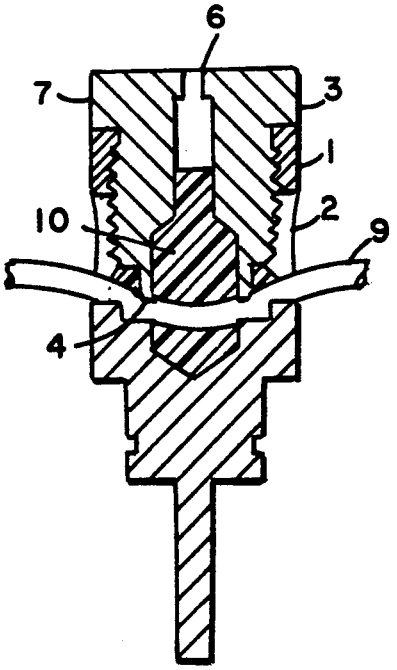
FIG. 4 is the same as FIG. 3 but additionally shows the sealing material.

In one example, FIGS. 1–4, a terminal in acocrdance with this invention comprises a clamp 1 having an aperture 2. Clamp 1 is internally threaded to accommodate screw 3. The end of screw 3 has a small cylindrical blunt edge 4 the inside diameter of which is the same as the diameter of a cylndrical cavity 5 at the bottom of clamp 1. There is an axial hole 6 through screw 3. At the top of screw 3 is a head 7 which is stopped by shoulder 8 of clamp 1 when screw 3 is screwed into clamp 1. Prior to insertion of an insulated telephone wire 9 into aperture 3, sealing material 10, for example, a gel such as shown in U.S. Pat. No. 4,824,390, would be injected into the bottom of clamp 1. In order to make electrical contact between clamp 1 and the metal core of telephone wire 9, screw 3 would be screwed into clamp 1 until blunt edge 4 displaced the insulation on telephone wire 9 and contacted the metal core within. During this step telephone wire 9 is being squeezed between blunt edge 4 and flat surface 11 of clamp 1, displacing telephone wire insulation into cavity 5 and squeezing gel 10 to completely seal around blunt edge 4 where it contacts the metal core of telephone wire 9, the excess gel 10 being accommodated within well 12 which is in communication with hole 6 of screw 3.

This terminal could be used, for example, in the telephone network interface device shown in U.S. Pat. No. 4,800,588. Telephone wire 10 would be installed by the telephone company running from a station protector in the network interface device to the terminal. The telephone subscriber would make connection to, for example, an extending connector post 13 at the end of terminal 12.

Figure 5:
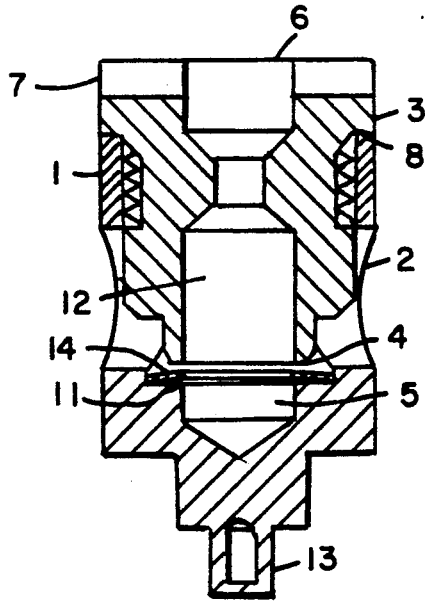
FIGS. 5 and 6 are sectional views of other terminals in accordance with this invention.

In the embodiment shown in FIG. 5, a ring-shaped spring washer 14 rests on flat surface 11. As screw 3 would be rotated inward, telephone wire 9 would be squeezed between blunt edge 4 and spring washer 14, while spring washer 14 was being compressed. When a small diameter wire 9 is used with this terminal, the spring force of spring washer 14 would be sized to enable screw 3 to displace the insulation on telephone wire 9 but not have enough force to sever the wire. When a large diameter wire is used, spring washer 14 would be completely compressed. This would ensure that not only the maximum force of spring 14 but also any additional force exerted by screw 3 would be applied to the contact with wire 9. Examples of ring-shaped washers that could be used are belleville washers, wave washers, finger spring washers and curved spring washers. Several spring washers 14 could be stacked on top of each other to provide proper load and deflection.

Figure 6:
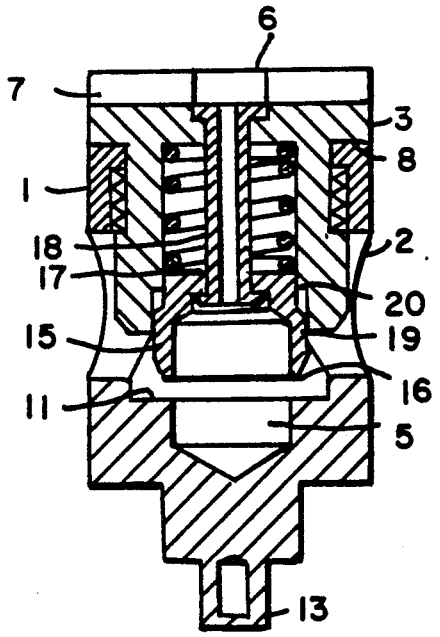

In the embodiment shown in FIG. 6, screw 3 does not directly contact telephone wire 10. Instead there is a floating cup 15 having cylindrical blunt edge 16 which makes contact with telephone wire 10. Disposed within screw 3 is a coiled spring 17 which exerts downward pressure on floating cup 15. A tube 18, axially disposed within coiled spring 17 and peened over at both ends, positions floating cup 15 within screw 3 and permits up-and-down movement of floating cup 15. Floating cup 15 has a shoulder 19 to engage landed edge 20 of screw 3. When telephone wire 9 is of small diameter, coiled spring 17 will be compressed as screw 3 is rotated inward, until shoulder 19 engages landed edge 20. The limitation of travel of screw 3 by shoulder 8 prevents blunt edge 16 from severing telephone wire 10. When a large diameter wire 10 is used, coiled spring 17 would similarly be compressed until shoulder 19 engages landed edge 20, at which point additional rotation of screw 3 would directly press blunt edge 16 against telephone wire 10.

Tube 18 is in alignmemt with axial hole 6. Thus sealing material 10 can be entered within floating cup 15 and into cylindrical cavity 5 through axial 6.

We claim:

1. An insulation displacement terminal comprising: a clamp, a portion of which is tubular, the tubular portion being internally threaded; an aperture in the clamp capable of receiving an insulated telephone wire; a secew having an axial hole therethrough and having a cylindrical blunt edge at the bottom thereof; the inside diameter of the cylindrical blunt edge being the same as, and in alignment with, a cylindrical cavity at the bottom of the clamp when the screw is screwed into the clamp; the screw having a head theron which stops against a shoulder on the clamp when the screw is screwed into the clamp so that the cylindrical blunt edge of the screw displaces the insulation on an insujlated telephone wire in the aperture and makes contact with a metal core in the insulated telephone wire without cutting through the metal core; the clamp having a flat surface peripheral the cylindrical cavity whereby the insulated telephone wire in the aperture is squeezed between the flat surface and the cylindrical blunt edge at the bottom of the scew.

2. The terminal of claim 1 wherein one or more ring-type spring washers is disposed between the cylindrical blunt edge and the flat surface.

3. The terminal of claim 1 containing, in addition, a sealing material within the terminal which seals the point of contact between the cylindrical blunt edge of the screw and the metal core of the insulated telephone wire.

4. The terminal of claim 3 wherein there is a well at the bottom of the screw which is in communication with the axial hole of the screw and which is capable of receiving sealing material which is displaced when the screw is screwed into the clamp.

5. An insultaion displacement terminal comprising: a clamp, a portion of which is tubular, the tubular portion being internally threaded; an aperture in the clamp capable of receiving an insulated telephone wire; a screw, having an axial hole therethrough, engaging the threads of the clamp; a floating cup partially disposed within the screw and movable up-and-down within the screw; a coiled spring disposed between the screw and the floating cup, the spring exerting downward pressure on the cup; the floating cup having a cylindrical blunt edge at the bottom thereof; the inside diameter of the cylindrical blunt edge being the same as, and in alignment with, a cylindrical cavity at the bottom of the clamp; the screw having a head thereon which stops against a shoulder on the clamp when the screw is screwed into the clamp so that the cylindrical blunt edge of the floating cup displaces the insulation on an insulated telephone wire in the aperture and makes contact with the metal core in the insulated telephone wire without cutting through the metal core; the clamp having a flat surface peripheral the cylindrical cavity whereby the insulated telephone wire in the aperture is squeezed between the flat surface and the cylindrical blunt edge at the bottom of the floating cup.

6. The terminal of claim 5 comprising, in addition, a tube axially disposed within the coiled spring and in alignment with the axial hole of the screw, the tube positioning the floating cup within the screw.

7. The terminal of claim 6 wherein the floating cup has a shoulder thereon to engage a landed edge within the screw when the coiled spring has attained sufficient compression.

* * * * *